US005547567A

United States Patent [19]

Madsen

[11] Patent Number: 5,547,567

[45] Date of Patent: Aug. 20, 1996

[54] APPARATUS FOR WASHING-DOWN SERIGRAPHICAL FRAMES AND FILTERPART FOR THE APPARATUS

[75] Inventor: Claus H. Madsen, Vedbæk, Denmark

[73] Assignee: CPS - Chemical Products & Services A/S, Denmark

[21] Appl. No.: 506,651

[22] Filed: Jul. 25, 1995

Related U.S. Application Data

[63] Continuation of Ser. No. 281,122, Jul. 28, 1994, abandoned, which is a continuation of Ser. No. 66,012, filed as PCT/DK91/00298, Sep. 30, 1991, published as WO92/05961, abandoned.

[30] Foreign Application Priority Data

Oct. 1, 1990 [DK] Denmark ..... 2363/90

[51] Int. Cl.[6] ..... B41F 35/00

[52] U.S. Cl. ..... 210/167; 210/196; 210/244; 210/496; 210/508; 210/509; 134/104.4; 134/111

[58] Field of Search ..... 210/167, 196, 210/244, 474, 477, 496, 500.26, 508, 509; 134/104.4, 111

[56] References Cited

U.S. PATENT DOCUMENTS

| | | | |
|---|---|---|---|
| 3,123,455 | 3/1964 | Paasche | 210/167 |
| 3,580,261 | 5/1971 | Key . | |
| 4,226,548 | 10/1980 | Reith | 134/11 |
| 4,469,595 | 9/1984 | Napadow | 210/167 |
| 4,658,842 | 4/1987 | Jensen | 134/183 |
| 4,768,533 | 9/1988 | Hall | 134/111 |
| 4,784,169 | 11/1988 | Striedlieck | 210/167 |
| 4,808,237 | 2/1989 | McCormick et al. . | |
| 5,056,948 | 10/1991 | Puder et al. | 134/172 |
| 5,398,708 | 3/1995 | Sheldon | 134/104.4 |
| 5,457,270 | 10/1995 | Hildebrand et al. | 134/104.2 |

FOREIGN PATENT DOCUMENTS

| | | |
|---|---|---|
| 1229975 | 12/1966 | Germany . |
| 2339906 | 2/1975 | Germany . |
| 2203813 | 10/1988 | United Kingdom . |

*Primary Examiner*—Peter A. Hruskoci
*Assistant Examiner*—Theodore M. Green
*Attorney, Agent, or Firm*—Finnegan, Henderson, Farabow, Garrett & Dunner, L.L.P.

[57] ABSTRACT

Apparatus for washing-down serigraphical frames by means of a cleaning liquid comprises a sing-like unit having V or U-shaped ends, in which unit the serigraphical frames are placed, a scavenging hose with affixed brush, a filter section, a circulation pump, a sludge discharge system and a recirculation system for liquid. The filter section comprises a filter tray having V or U shaped cross-sections and a loosely fitted recovable filter mat of a chemically resistant material, preferably a polyester coating glass fibre material or polypropylene, with optimum surface. The collected sludge is discharged at intervals through the bottom of the tank unit, the unit cleaning liquid is recirculated continuously after filtration and added with fresh cleaning liquid. The apparatus is equipped with a double-acting suction system for vapours from the cleaning liquid and involves substantial advantages to the working environment.

6 Claims, 3 Drawing Sheets

APPARATUS FOR WASHING-DOWN SERIGRAPHICAL FRAMES AND FILTERPART FOR THE APPARATUS

This application is a continuation of application Ser. No. 08/281,122 filed Jul. 28, 1994, now abandoned, which is a continuation of application Ser. No. 08/066,012, filed as PCT/DK91/00298, Sep. 30, 1991 published as WO92/05961, now abandoned.

FIELD OF THE INVENTION

The present invention relates to an apparatus for washing-down serigraphical frames by means of a cleaning liquid, the apparatus comprising a sink-like tank unit having V or U shaped ends, in which tank unit the serigraphical frames are placed, a scavenging hose with affixed brush, a filter section, a circulation pump, a sludge discharge system and a recirculation system for filtered cleaning liquid.

BACKGROUND OF THE INVENTION

Cleaning-off printing inks or serigraphical dyes from stencils, printing plates, serigraphical frames, rollers or the like has for many years been performed by means of cleaning liquids either containing substances which according to the definitions of the National Agency of Environmental Protection must be classified "hazardous substances" or containing low-boiling aromatic solvents. Such cleaning liquids involve considerable health hazards to the persons working with the liquids.

Recently the applicant has developed a group of efficient and versatile cleaning liquids for the serigraphical industry. The liquids, which do not contain hazardous substances, have proved to be at least as efficient as the cleaning liquids previously used, and they are significantly less health hazardous.

A group of similar cleaning liquids, which additionally may contain as much as 25% (v/v) high-boiling aromatic compounds, has also been developed by the applicant. These liquids are also at least as efficient as the cleaning liquids previously used and considerably less health hazardous.

Even though these newly developed groups of cleaning liquids have made possible a considerable—and much needed—improvement of the working environment within the serigraphical industry, there is still need for further improvements, because washing-down serigraphical frames is traditionally performed manually with entailing large risk of breathing-in vapours from the cleaning liquids.

Consequently, it is an object of the present invention to provide an apparatus for washing-down serigraphical frames, which apparatus in particular is suited for use together with the abovementioned newly developed cleaning liquids with reduced health hazard. An efficient washing-down apparatus of the kind in question will be able to further lower this health hazard.

SUMMARY OF THE INVENTION

The above object is achieved with the apparatus according to the invention which is characterized in that the filter section comprises a filter tray having V or U shaped cross-section and a loosely fitted removable filter mat of a chemically resistant material having optimum surface, that the collected sludge is discharged at intervals through the bottom of the tank unit, that the used cleaning liquid after filtration is recirculated continuously and added with fresh cleaning liquid as needed, and that the apparatus is provided with a doubleacting suction system for vapours from the cleaning liquid.

BRIEF DESCRIPTION OF THE DRAWINGS

The apparatus according to the invention will be described in more detail, reference being made to the drawing in which.

DESCRIPTION OF THE PREFERRED EMBODIMENT

Figure 1:
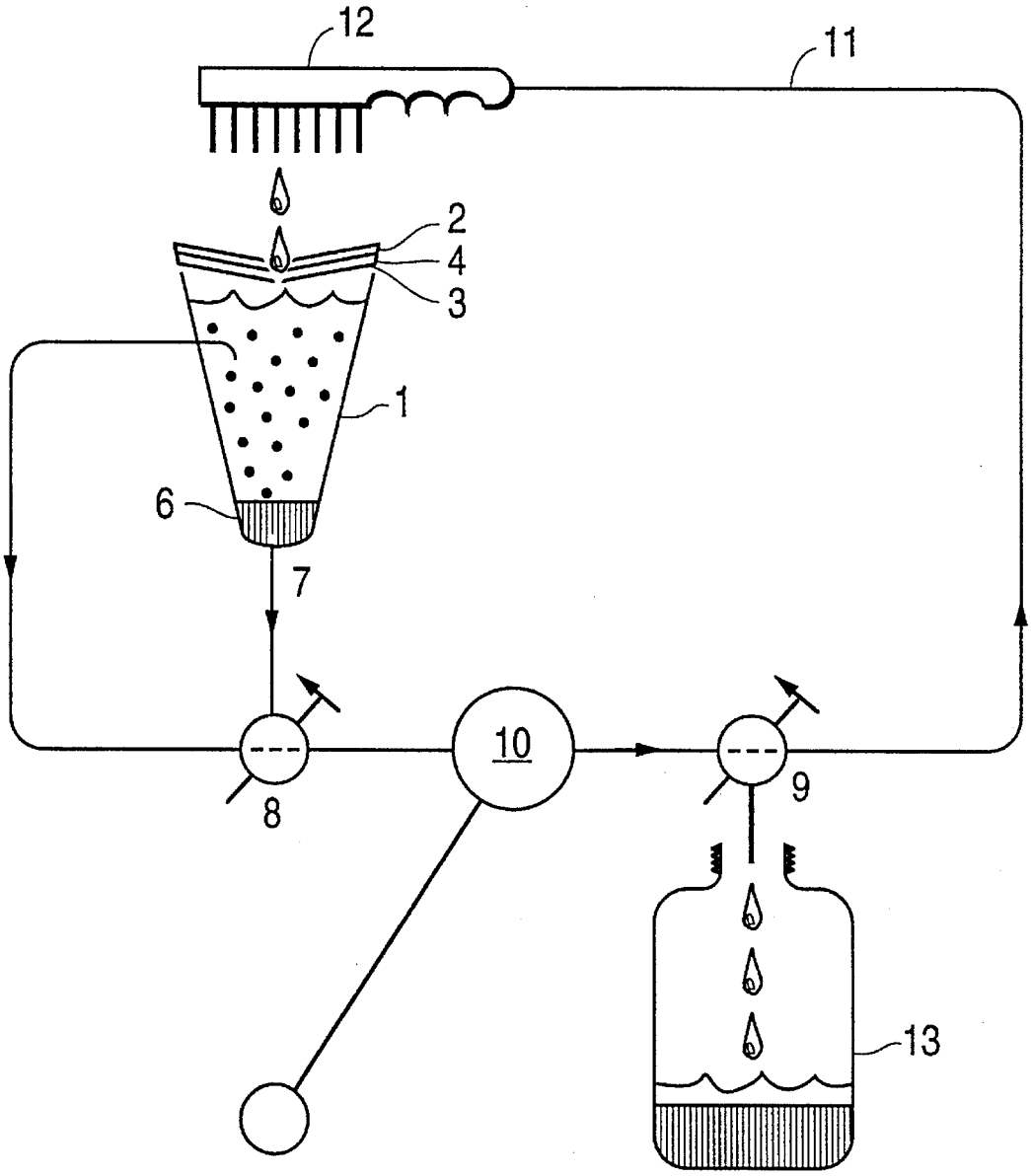
FIG. 1 is a schematical diagram illustrating the construction of the apparatus according to the invention.

The present apparatus comprises a tank unit (1), having in its longitudinal direction a "crib-like" shape with V or U shaped end faces. At the top of the tank there is mounted a lid (2) being weakly V shaped (e.g. 160°). At the bottom of the V shape the lid is provided with a row of holes, so that liquid may drain down along the entire length of the lid.

The washed-down cleaning liquid from the washing process drains through the row of holes down onto the center of a similar underlying V or U shaped filter tray (3) (sieve filter). On the filter tray a loose filter mat (4) has been rolled out, which mat is easily removable.

After filtration of the liquid through the filter (4) the liquid drains to the lower part of the tank from where it is discharged through the liquid outlet (5) and recirculated for renewed use.

In the lowermost V or U shaped tip (6) of the tank which e.g. forms an angle of 60° a pumping-out system (7) for sludge is provided along the entire length of the tank. This system, which can be dismantled for cleaning the apparatus, comprises a suction pipe positioned in the longitudinal direction and having downwardly directed suction holes or an angle section *7a* positioned on support means with its tip pointing upwardly. The pipe or the angle section are preferably positioned at a distance of 4–8 mm from the sides and bottom of the tank. The apparatus according to the invention operates in accordance with two setting possibilities:

(1) Recirculation/operation setting (2) Pumping-out of sludge/emptying

The two setting possibilities are controlled by two ball valves (8,9). A circulation pump (10) is inserted between the ball valves, which are of the three-way-type. Activation of the ball valves can be automatized.

When the apparatus has been set for operation by means of the two valves, the filtered cleaning liquid is recirculated, as described above, and passed through the hose (11) out into the brush (12) which is used manually for the washing-down frames.

For sludge discharge the two ball valves are activated to the second setting possibility whereby the sludge settled in the tank is discharged by means of the circulation pump into the tank unit (13) for destruction.

The apparatus according to the invention is provided with a double-acting suction system for efficient removal of solvent vapours. The systems operates simultaneously according to an air curtain principle in front and a rim suction principle at the back.

The air curtain 14 is provided by means of a blow-system with a plurality of holes 15 positioned in the front edge 16 of the sink 1. A correspondingly wide suction gap provided in the upper front edge of the apparatus ensures the required venting.

The rim suction of the apparatus functions by means of a suction duct 17 provided in the rear wall, which duct encircles the light face positioned in the rear wall 18 for illuminating the serigraphical frames. This double-acting suction system has proved to give an optimum degree of efficiency, as the air curtain in an efficient way supplements the rim suction. The latter is very efficient along the circumference of the light face, but not as efficient in the centre thereof. This lacking effect can be fully compensated for by the air curtain which at the same time shields the operator from solvent vapours during the washing-down process.

During the washing-down process the air curtain is thus only intersected by the tube or handle carrying the brush 12 with which the washing-down is performed.

Figure 2:
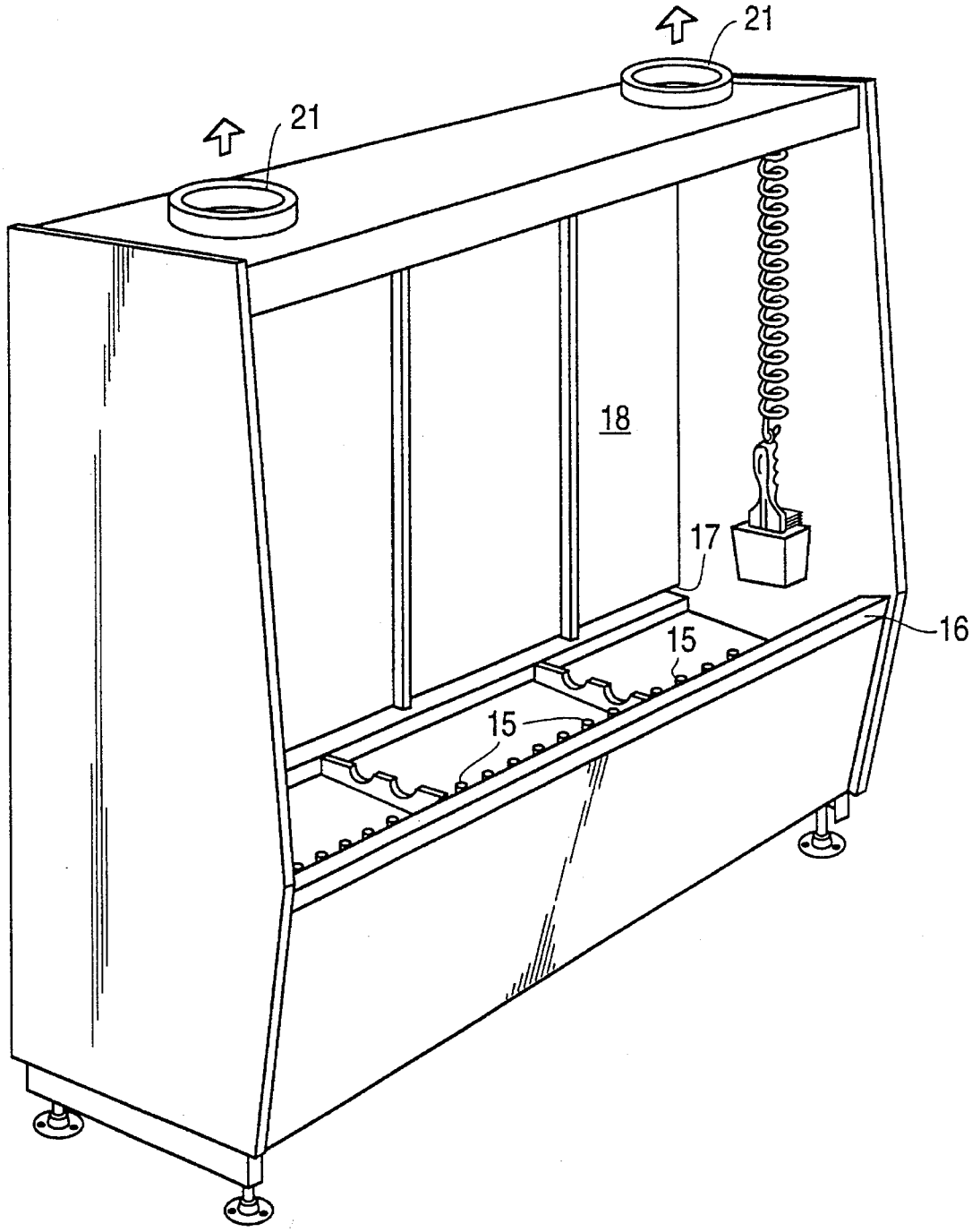
FIGS. 2 and 3 show in detail the construction of the apparatus according to a preferred embodiment.

FIG. 2 is a perspective sketch of the appearance of the apparatus according to a typical embodiment. Typically, the apparatus has a width of about 2.7 m, a depth of 0.8 m and a height of 2.2 m, but these dimensions are only intended for guidance, as the apparatus may of course be dimensioned according to need. In FIG. 3A and B show blowing-in and vent providing the air curtain.

The removable filter employed in the apparatus according to the invention is primarily of a chemically resistant fibre type, preferably a special chemically resistant glass fibre type, and secondarily a polypropylene filter cloth. Both types have surprisingly been found to be able to retain an optimum surface throughout the entire calculated life. Hereby large uniform through-flow velocity can be obtained without dirt cloggings.

The primary filter type which has proved to be particularly suited for the object of the invention, is supplied by the German company Glaswerk Sculler GmbH, Wertheim/Main. The filter is called "C-Glas-Vlies für Spezialbereiche, type S 5041 Sac 50/2-S-H6" and weighs as much as 100 g per $m^2$. This filter type has been developed for completely different purposes than the one intended according to the invention, viz. for use as reinforcement tissue, in particular in the boat industry, and for special air filtration purposes.

The filter material is a woven glass fibre material provided with a special polyester coating. This special combination of materials exhibits large durability and is well suited for filtration of both the cleaning liquids described above and strongly alkaline water-based solvents (pH 13 and above).

The secondary filter type which has proved suited for the purpose, is supplied from the American company Consler Corporation, Homeoye Falls, N.Y. It is a polypropylene sheet filtration material with pore sizes of as much as 100 μm. The filter type has been developed for use in the supplier's own production of filter cartridges and for this purpose it is delivered from the factory in rolls for sheet cutting. The material has not previously been used for filtration purposes of the kind to which the present invention relates.

The polypropylene cloth is woven from 100% clean polypropylene fibres. Such a filter exhibits long durability and is also well suited for filtration of both the cleaning liquids mentioned and strongly alkaline waterbased solvents (pH 13 and above).

Figure 3:
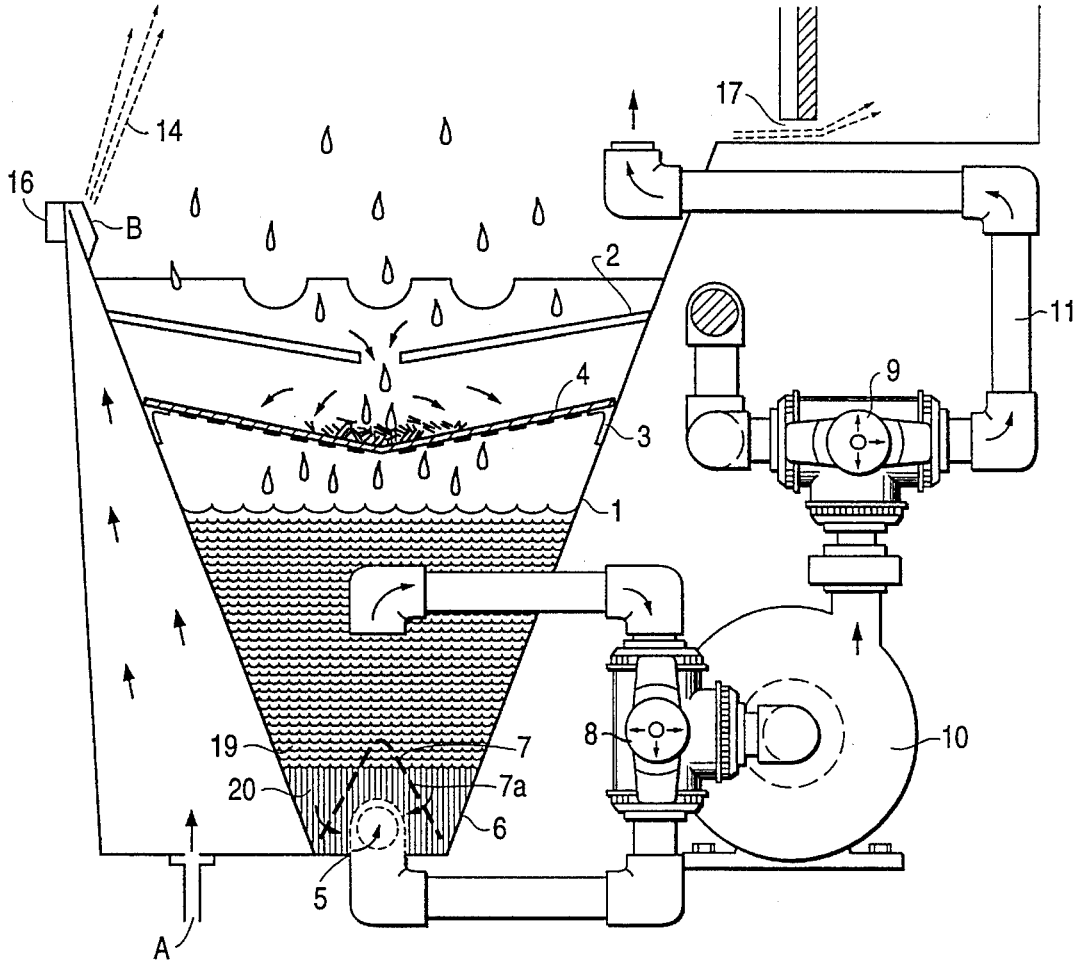

As is seen from FIG. 3, the filter unit retains its effect at a continous filling from the V shaped tip of the filter towards the sides. Hereby a long life is obtained.

According to a preferred embodiment the filter is supplied in a carton along with a polyethylene disposal bag, a closing strip and throw-away gloves. The used (sludge filled) filter is rolled up and placed in the disposal bag together with the throw-away gloves used when removing the filter. The bag is closed, put into the carton and sent for destruction. When the new filter has been positioned in the filter section of the apparatus the apparatus is ready again for operation.

The oils, resins and particles which are dissolved in the cleaning liquid when the apparatus is in operation and having a particle size of less than 5 μm, slowly precipitate along the inclined, smooth side walls 19 of the tank and form a sludge-containing substance 20 which at intervals (e.g. weekly) is pumped out and destructed.

As regards environment and safety the "layer-divided" drain, filtration and chemical sump provide a number of secondary advantages:

The drain holes in the lid (2) and the underlying sealing of the sieve-filter (3) make evaporations from the sump during standstill minimal. During standstill any evaporation from the chemical sump must thus pass both filter mat and lid with row of holes. This provides a braking effect as regards emission of vapours.

In the uppermost front edge of the washing chamber there may additionally be provided a "roller curtain" (not shown) with a special coating, which curtain after finished washing-down is rolled down. The remaining vapours will subsequently—according to the rim suction principle—be passed towards the suction ducts 21 situated at the back, which ducts are connected to a central suction apparatus.

By the apparatus according to the invention it has become possible to a very significant extent to eliminate the emission of vapours from the solvent to the surroundings, so that the staff performing washing-down of serigraphical frames by means of the apparatus, essentially avoid breathing in the vapours. As the staff at the same time avoid physical contact with the cleaning liquids—both when pumping out sludge and during the washing process—the users of the apparatus gain very substantial advantages in their working environment.

I claim:

1. Apparatus for washing down serigraphical frames with a cleaning fluid, which apparatus comprises:

(a) a tank unit in which serigraphical frames are placed for washing down and which includes an elongated sink for collecting used cleaning fluid, said sink having an upper portion, a lower portion and longitudinally extending front and back walls each inclined inwardly and downwardly from the upper portion toward the lower portion;

(b) a scavenging hose and brush affixed thereto for washing down the frames;

(c) a filter tray extending across the upper portion of the sink and sloping downwardly from each of the walls;

(d) a filter mat fitted on the tray, being formed of a chemically resistant material and for filtering sludge from cleaning fluid used for washing down the frames;

(e) sludge discharge means connected to the lower portion for intermittently discharging sludge collected in the bottom of the sink;

(f) pumping means connected to the sink above the lower portion for removing used cleaning fluid for the sink and for circulating the used cleaning fluid after filtration to the hose and for the the addition of fresh cleaning liquid to the hose;

(g) means for blowing an air curtain upwardly across an upper edge of the front wall of the sink so as to shield an operator of the apparatus from vapors from the cleaning fluid when frames are being washed down; and (h) a suction duct above the back wall for removal of vapors of the cleaning liquid.

2. Apparatus according to claim 1 wherein the chemically resistant material is a glass fibre material.

3. Apparatus according to claim 2 wherein the glass fibre material is a woven material weighing as much as 100 $g/m^2$ and provided with a polyester coating.

4. Apparatus according to claim 1 further including a vertical back wall extending upwardly from the inclined back wall and wherein the suction duct is positioned in the vertical back wall and operates simultaneously with the air curtain.

5. Apparatus according to claim 1, wherein the chemically resistant material is polypropylene having a pore size of as much as 100 μm.

6. Apparatus according to claim 1, wherein the filter tray has a V or U shaped cross-section and the filter mat is loosely fitted on the tray and removable therefrom, and the sludge discharge means is positioned at the bottom of the sink and comprises a suction pipe extending in longitudinally therein and having downwardly directed holes or an angle section positioned on support means and having a tip pointing upwardly, and wherein two suction gaps are provided between the walls of the sink and the angle section.

* * * * *

UNITED STATES PATENT AND TRADEMARK OFFICE

CERTIFICATE OF CORRECTION

PATENT NO. : 5,547,567
DATED : August 20, 1996
INVENTOR(S) : Claus H. Madsen

It is certified that error appears in the above-indentified patent and that said Letters Patent is hereby corrected as shown below:

Title page, Abstract, line 2, delete "sing-like unit" and insert therefore --sink-like tank unit--.

Signed and Sealed this

Twenty-ninth Day of October 1996

*Attest:*

*Attesting Officer*

Bruce Lehman

BRUCE LEHMAN

*Commissioner of Patents and Trademarks*